US009534543B2

(12) United States Patent
Goodall

(10) Patent No.: US 9,534,543 B2
(45) Date of Patent: Jan. 3, 2017

(54) SYSTEMS AND METHODS FOR INHIBITING DFCO

(71) Applicant: GM Global Technology Operations LLC, Detroit, MI (US)

(72) Inventor: James A. Goodall, Hartland, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 322 days.

(21) Appl. No.: 14/219,420

(22) Filed: Mar. 19, 2014

(65) Prior Publication Data

US 2015/0198100 A1 Jul. 16, 2015

Related U.S. Application Data

(60) Provisional application No. 61/928,159, filed on Jan. 16, 2014.

(51) Int. Cl.

| | |
|---|---|
| ***F02D 17/04*** | (2006.01) |
| ***F02D 41/00*** | (2006.01) |
| ***F02D 41/02*** | (2006.01) |
| *F02M 25/06* | (2016.01) |

(52) U.S. Cl.

CPC ..... *F02D 17/04* (2013.01); *F02D 41/0087* (2013.01); *F02D 41/0235* (2013.01); *F02D 2200/0804* (2013.01); *F02D 2250/08* (2013.01); *F02M 25/06* (2013.01)

(58) Field of Classification Search

CPC .. F02D 41/0087; F02D 41/042; F02D 41/123; F02D 41/0235; F02D 41/0005; F02D 41/107; F02D 13/06; F02D 17/023; F02D 17/02; F02D 17/04; F02D 2250/08; F02D 2200/0804

USPC ..... 123/481, 325, 332, 479, 198 F; 701/112

See application file for complete search history.

(56) References Cited

U.S. PATENT DOCUMENTS 5,094,206 A * 3/1992 Buslepp ..... F02D 9/02 123/325
6,637,194 B2 * 10/2003 Kakuyama ..... B01D 53/9454 60/274
8,467,923 B2 * 6/2013 Fedewa ..... B60W 10/06 123/198 DB
8,781,713 B2 * 7/2014 Brennan ..... F02D 13/06 123/198 F (Continued)

FOREIGN PATENT DOCUMENTS

EP 0501538 B1 * 12/1994 ..... F02D 9/02

*Primary Examiner* — Grant Moubry

(57) ABSTRACT

A system including a DFCO module. The DFCO module is configured to operate in a DFCO mode to deactivate fuel to a cylinder of an engine. A first flow rate module is configured to determine a reaction gas flow rate. An offset module is configured to determine a temperature offset value based on the reaction gas flow rate. A first temperature module is configured to estimate a first temperature of a catalyst of an exhaust system of the engine. A summer is configured to sum the temperature offset value and the first temperature to generate a summation value. A second temperature module configured to estimate a second temperature of the catalyst based on the summation value. A comparison module is configured to perform a first comparison between the second temperature and a threshold and generate an inhibit signal to inhibit operation in the DFCO mode based on the first comparison.

18 Claims, 4 Drawing Sheets

(56) References Cited

U.S. PATENT DOCUMENTS 8,857,157 B2 * 10/2014 Hamama ..... F01N 9/00
60/285
9,127,603 B2 * 9/2015 Knoebel ..... F02D 41/123

* cited by examiner

SYSTEMS AND METHODS FOR INHIBITING DFCO

CROSS-REFERENCE TO RELATED APPLICATIONS

This application claims the benefit of U.S. Provisional Application No. 61/928,159, filed on Jan. 16, 2014. The disclosure of the above application is incorporated herein by reference in its entirety.

FIELD

The present disclosure relates to internal combustion engines and more particularly to systems and methods for controlling deceleration fuel cut-off.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

During certain operating conditions of an internal combustion engine (ICE), fuel to one or more cylinders of the ICE may be disabled to conserve fuel. The deactivation of fuel to one or more cylinders is referred to as deceleration fuel cut-off (DFCO). While DFCO is enabled, fuel vapors in a crankcase of the engine can evaporate (or boil) and be provided via a positive crankcase ventilation (PVC) system to one or more of the cylinders (referred to as combustion chambers). This can especially occur when fuel-in-oil dilution levels are high.

SUMMARY

A method is provided and includes applying a temperature offset to a catalyst temperature model during a DFCO mode and disabling DFCO mode when a modeled catalyst temperature exceeds a threshold. The temperature offset is applied to a steady-state target temperature as a function of fuel vapor flow rate. The steady-state target temperature may be modeled.

In other features, a system is provided and includes a DFCO module. The DFCO module is configured to operate in a DFCO mode to deactivate fuel to a cylinder of an engine. A first flow rate module is configured to determine a reaction gas flow rate. An offset module is configured to determine a temperature offset value based on the reaction gas flow rate. A first temperature module is configured to estimate a first temperature of a catalyst of an exhaust system of the engine. A summer is configured to sum the temperature offset value and the first temperature to generate a summation value. A second temperature module configured to estimate a second temperature of the catalyst based on the summation value. A comparison module is configured to perform a first comparison between the second temperature and a threshold and generate an inhibit signal to inhibit operation in the DFCO mode based on the first comparison.

In other features, a method is provided and includes: operating an engine in a DFCO mode to deactivate fuel to a cylinder of the engine; determining a reaction gas flow rate; determining a temperature offset value based on the reaction gas flow rate; and estimating a first temperature of a catalyst of an exhaust system of the engine. The method further includes: summing the temperature offset value and the first temperature to generate a summation value; estimating a second temperature of the catalyst based on the summation value; performing a first comparison between the second temperature and a threshold; and generating an inhibit signal to inhibit operation in the DFCO mode based on the first comparison.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Typically, fuel vapors that are received in combustion chambers of an engine are burned in the combustion chambers. However, while DFCO is enabled and an air/fuel mixture is to lean too combust, the fuel vapors can pass from the engine to an exhaust system unburned. As a result, the fuel vapors that pass through the ICE can come in direct contact with a catalyst in the exhaust system. Contact of the fuel vapors with the catalyst can result in generated heat in the catalyst due to, for example, combustion of the fuel vapors in the catalyst. This increases the temperature of the catalyst. If exposure to the fuel vapors continues for an extended period of time, temperature of the catalyst can exceed a predetermined temperature, which can damage the catalyst.

Accordingly, systems and methods are disclosed herein for inhibiting DFCO to prevent temperatures of a catalyst from exceeding a predetermined temperature above which the catalyst can be damaged. The systems include control modules and DFCO inhibit modules for determining certain conditions during which DFCO is temporarily disabled.

Figure 1:
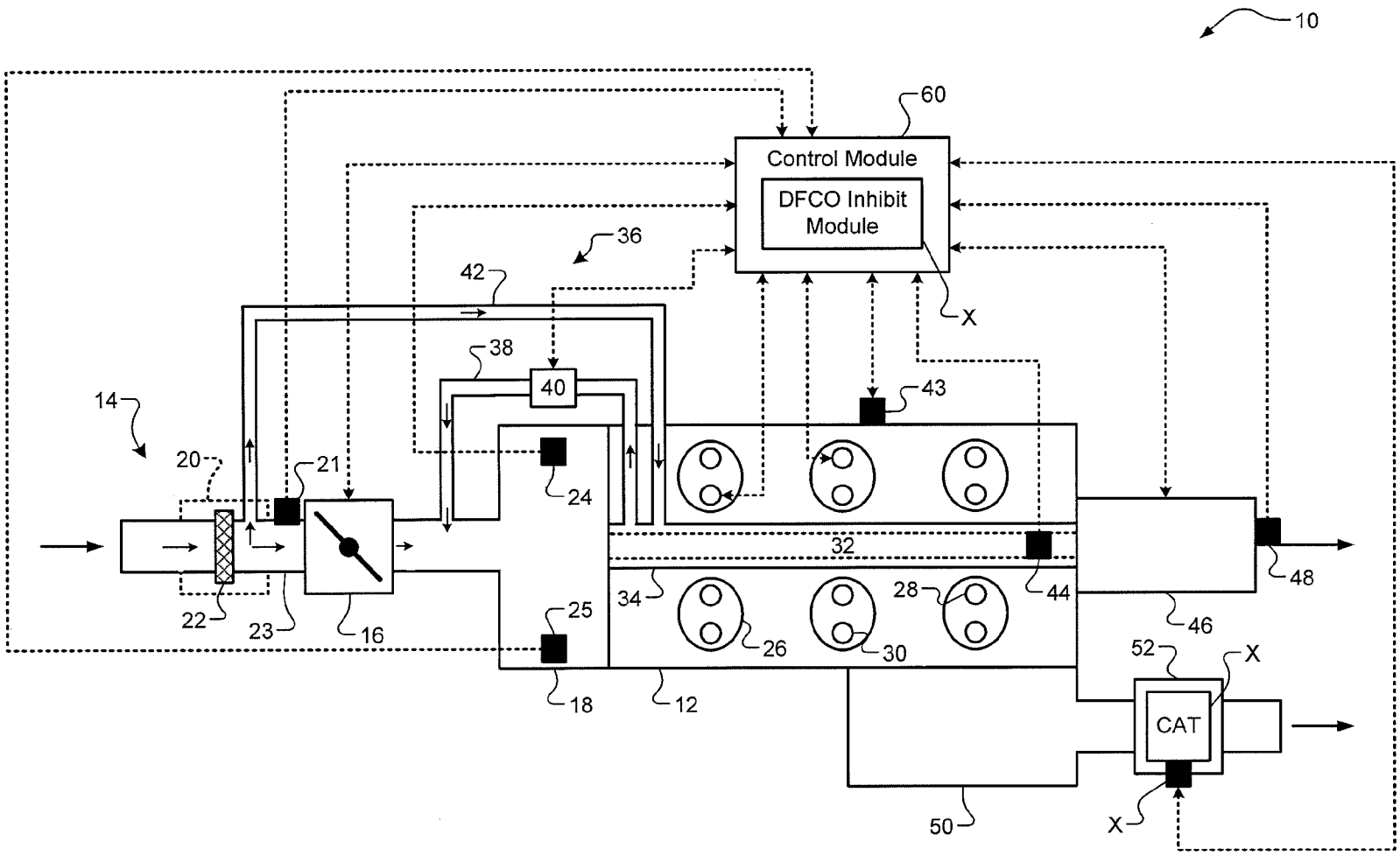
FIG. 1 is a functional block diagram of an engine system incorporating a DFCO inhibit module in accordance with the present disclosure.

FIG. 1 shows an engine system 10 that includes an internal combustion engine (ICE) 12 (e.g., a spark ignition direct injection (SIDI) engine or a homogeneous charge compression ignition (HCCI) engine). The ICE 12 draws air into an intake manifold 18 through an induction system 14 that may be regulated by a throttle 16. The induction system 14 may include an air filter housing 20 and an air filter 22. The air filter 22 may filter air drawn into the intake manifold 18 to remove particulates. A mass air flow (MAF) sensor 21 measures a rate of airflow through the throttle 16 into the intake manifold 18. For example, the measured MAF rate may indicate a load on the ICE 12. An oxygen sensor 24 measures an oxygen concentration of air inside the intake manifold 18. The oxygen sensor 24, however, may also be located in another suitable location within the induction system 14. A manifold air pressure (MAP) sensor 25 may be included to provide a MAP.

Air in the intake manifold 18 is distributed to cylinders 26. Fuel injectors 28 inject fuel into intake ports of the cylinders 26 (port fuel injection) or directly into the cylinders 26 (direct fuel injection). In the mixed combustion mode, spark plugs 30 may assist in igniting the air-to-fuel (A/F) mixture within the cylinders 26 to drive pistons which rotatably turn a crankshaft 32 and generate drive torque. In a HCCI combustion mode, however, the A/F mixture may be compressed until auto-ignition due to a critical or predetermined pressure and/or temperature of the A/F mixture being exceeded. The crankshaft 32 may be connected to pistons (not shown) of the cylinders 26, respectively, and housed within a crankcase 34 (shown in FIG. 2) that includes oil for lubrication of moving parts.

A PCV system 36 may draw blow-by vapors from the crankcase 34 and into an air inlet duct 23 at a location downstream from the air filter 22. The PCV system 36 may include a PCV hose 38 that connects the crankcase 34 to the intake manifold 18. The PCV system 36 may also include a PCV valve 40 or other flow regulator that regulates the flow of blow-by vapors from the crankcase 34 to the intake manifold 18. For example, the PCV valve 40 may include a spring-loaded valve (or an orifice or another airflow regulating device) that opens based on pressure differential between the crankcase 34 and the intake manifold 18.

The PCV valve 40 may also be another suitable type of valve or other flow regulator such as an electronic valve controlled by a control module 60. In some implementations the PCV system 36 may further include a breather tube 42 that connects the crankcase to the air filter housing 20 or to the air inlet duct 23 of the induction system 14 at a location downstream from the air filter 22. The breather tube 42 allows fresh air to circulate in the crankcase 34 further diluting the blow-by vapors and preventing oil contamination (i.e., improved circulation).

An engine temperature sensor 43 measures a temperature of the ICE 12. For example, the engine temperature sensor 43 may measure intake air temperature (IAT), engine coolant temperature (ECT), or engine oil temperature (EOT). The engine temperature sensor 43, therefore, may be located at another suitable location. In addition, the engine temperature sensor 43 may measure another suitable temperature. In some implementations, two or more engine temperature sensors 43 may be implemented.

An engine speed sensor 44 measures a rotational speed of the crankshaft 32 (i.e., engine speed). For example, the engine speed sensor 44 may measure the engine speed in revolutions per minute (RPM). A transmission 46 transfers the drive torque from the crankshaft 32 to a driveline (e.g., wheels) of a vehicle. In some implementations, the transmission 46 may be coupled to the crankshaft 32 via a fluid coupling such as a torque converter (not shown). A transmission output shaft speed (TOSS) sensor 48 measures a rotational speed of an output shaft of the transmission 46. For example, the TOSS sensor 48 may measure the TOSS in RPM. Measurements from the TOSS sensor 48 may be used to determine vehicle speed.

Exhaust gas resulting from combustion may be expelled from the cylinders 26 into an exhaust manifold 50. An exhaust treatment system (ETS) 52 may treat the exhaust gas in the exhaust manifold 50 to remove particulates and/or decrease emissions before releasing the exhaust gas into the atmosphere. For example, the ETS 52 may include at least one of oxidation catalysts, nitrogen oxide absorbers/adsorbers, selective catalytic reduction systems, particulate matter filters, and three-way catalytic converters. As an example, a catalyst 53 is shown. A temperature of an inlet gas of the catalyst 53, a temperature of an outlet gas of the catalyst 53, and/or a temperature (brick temperature $T_{brick}$) of the catalyst 53 may be measured directly via one or more temperatures sensors (one catalyst temperature sensor 55 is shown) or may be determined indirectly based on other parameters and/or conditions of the ICE 12, the ETS 52 and/or the catalyst 53.

The control module 60 controls operation of the engine system 10. The control module 60 may receive signals from the throttle 16, the MAF sensor 21, the oxygen sensor 24, the fuel injectors 28, the spark plugs 30, the PCV valve 40, the engine temperature sensor 43, the engine speed sensor 44, the transmission 46, the TOSS sensor 48, the ETS 52, and/or the catalyst temperature sensor 55. The control module 60 may control the throttle 16, the fuel injectors 28, the spark plugs 30, the PCV valve 40, the transmission 46, the ETS 52, and/or the EGR valve 58.

The control module 60 may control DFCO and include a DFCO inhibit module 62. DFCO may be enabled during first operating conditions. The DFCO inhibit module 62 may deactivate DFCO during second operating conditions. This is further described below with respect to FIGS. 3-4.

Figure 2:
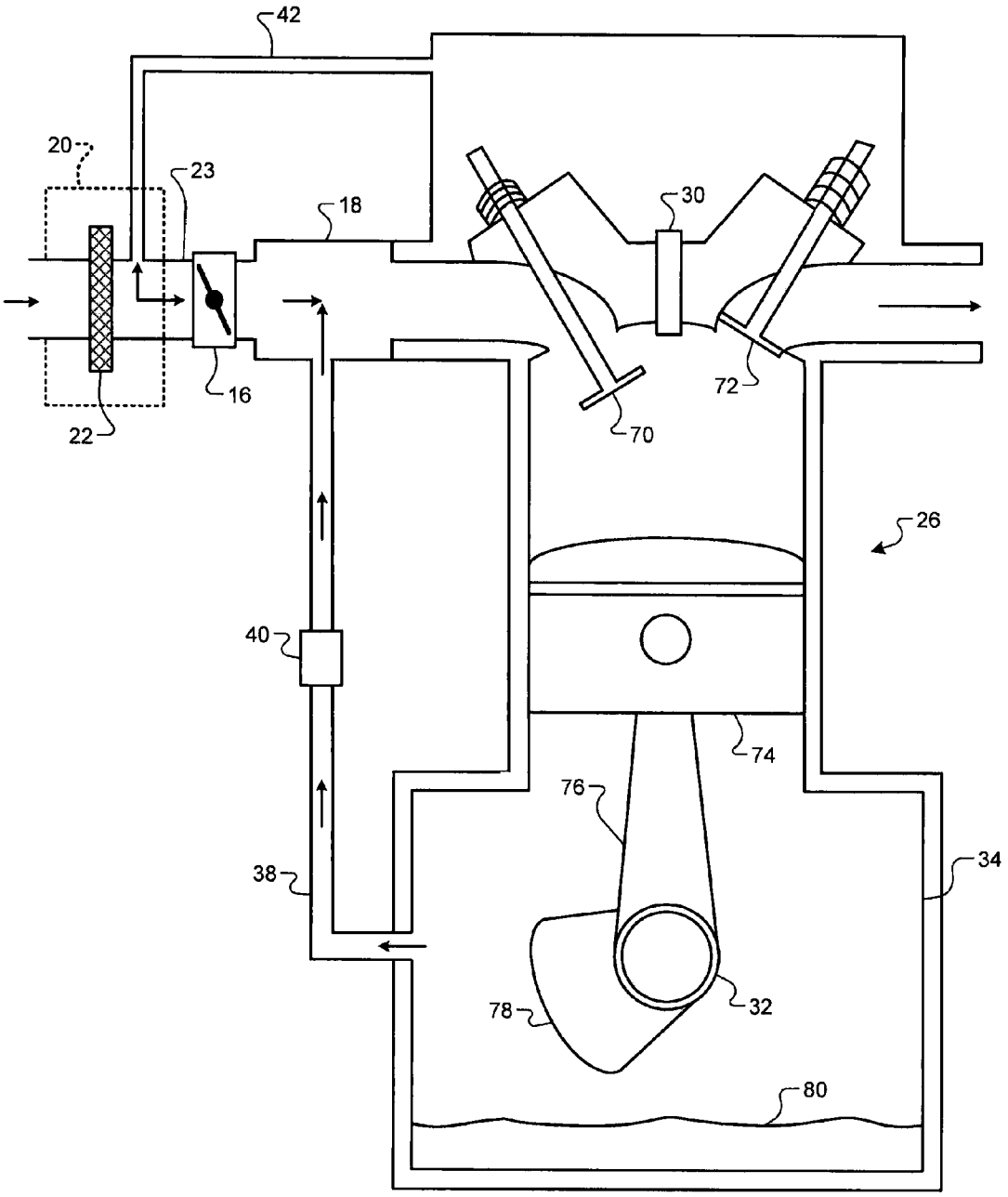
FIG. 2 is a cross-sectional view of a cylinder illustrating operation of a PCV system.

FIG. 2 shows a cross-sectional view of a cylinder illustrating operation of the PCV system 36 of FIG. 1. The cylinder may be one of the cylinders 26 of FIG. 1. The cylinder 26 draws in air from the intake manifold 18 via an intake valve 70. The cylinder 26 expels exhaust gas produced during combustion into the exhaust manifold 50 via an exhaust valve 72. The intake valve 70 and the exhaust valve 72 may be actuated by one or more camshafts (not shown). The control module 60 controls timing of the intake valve 70 and/or the exhaust valve 72.

The cylinder 26 further includes a piston 74. The piston 74 compresses the A/F mixture within the cylinder 26 during a compression stroke of the ICE 12. The A/F mixture is combusted (e.g., either auto-ignited or via assist from the spark plug 30) to drive the piston 74 downward generating drive torque. The drive torque rotates the crankshaft 32 which is connected to the piston 74 using a connecting rod 76. The crankshaft 32 may be connected to a counterweight 78. The crankcase 34 houses components of the cylinder 26. Specifically, the crankcase 34 includes oil 80 that lubricates moving components of the cylinder 26.

As previously described, blow-by vapors may enter the crankcase 34 and contaminate the oil 80 causing damage and/or decreased performance. The PCV system 36, however, vents blow-by vapors from the crankcase 34. Specifically, the PCV hose 38 may connect the crankcase 34 to the intake manifold 18 at a location downstream from the throttle 16. The PCV valve 40 may open when the blow-by vapors build up to exceed a critical pressure, thereby venting the blow-by vapors from the crankcase 34 into the intake manifold 18. Additionally, as previously described, the PCV system 36 may further include a breather tube 42 that connects the crankcase 34 to the air inlet duct 23 at a location downstream from the air filter 22. In other words, filtered air may flow through the breather tube 42 into the crankcase 34 further diluting the blow-by vapors and improving circulation which improves performance of the PCV system 36.

Figure 3:
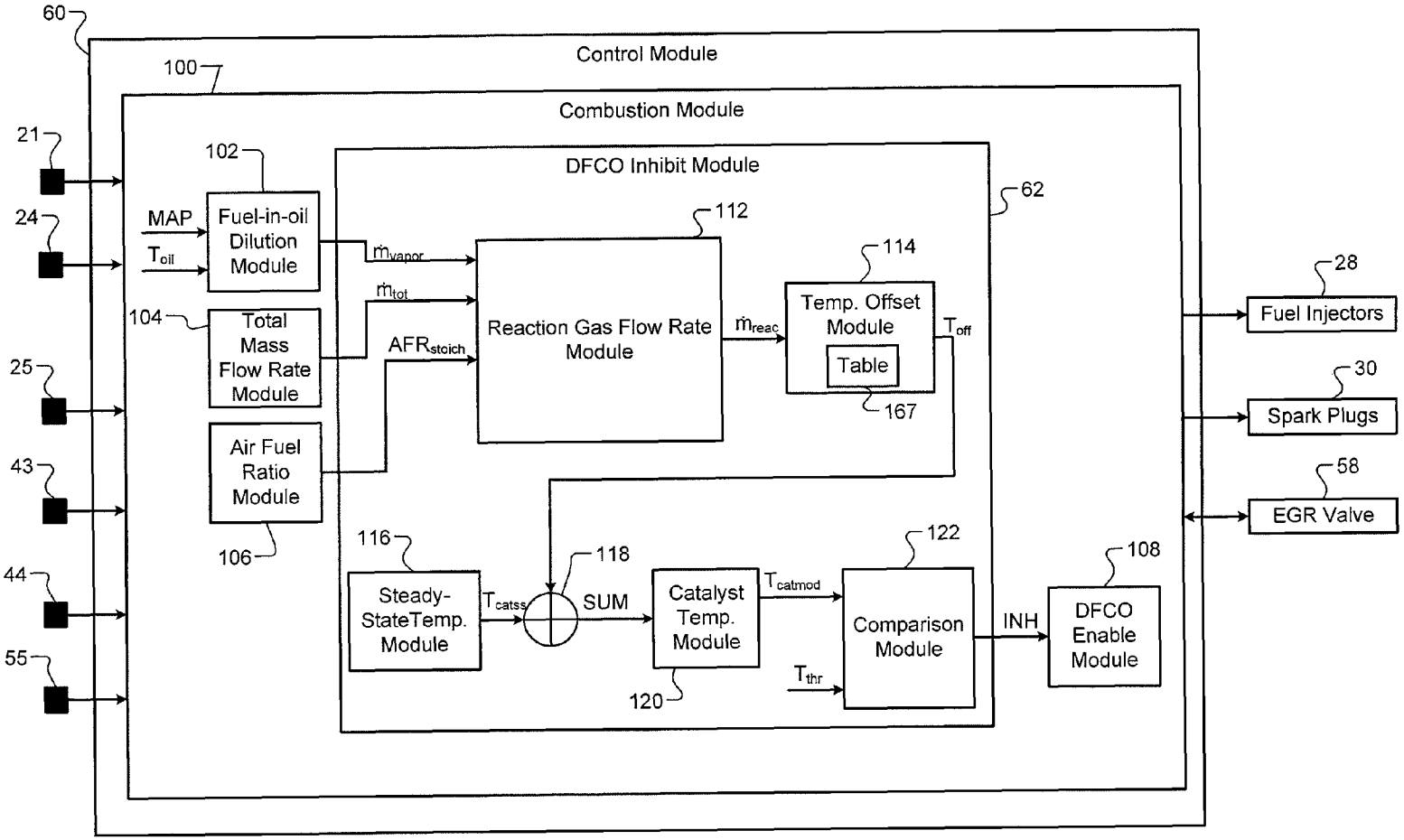
FIG. 3 is a functional block diagram of a control module in accordance with the present disclosure.

FIG. 3 shows the control module 60. The control module 60 includes a combustion module 100. The combustion module 100 receives signals from various sensors, such as signals from the sensors 21, 24, 43, 44, and 55. The combustion module 100 controls a combustion mode of the ICE 12 based on the signals including controlling operation of the fuel injectors 28 and the spark plugs 30. The combustion module 100 may determine various parameters based on the sensor signals including, for example, engine load, engine speed and engine temperature. Engine load may be based on measurements from the MAF sensor 21. Engine speed may be based on measurements from the engine speed sensor 44. Engine temperature may be based on measurements from the engine temperature sensor 43. The parameters may also include other suitable engine and/or exhaust system parameters. The combustion module 100 may control the combustion mode of the ICE 12 based on an oxygen concentration and oxygen concentration thresholds.

The combustion module 100 may include a fuel-in-oil dilution module 102, a total mass flow rate module 104, an air fuel ratio module 106, the DFCO inhibit module 62, and a DFCO enable module 108. The fuel-in-oil dilution module 102 is configured to determine a total fuel vapor flow rate $\dot{m}_{vapor}$ (or an amount of fuel lost to oil in crankcase) per cylinder, per bank of cylinders, and/or for all cylinders of the ICE 12. This may be determined based on the signals from the sensors 21, 25, 43, 44, position of the throttle 16, amounts and timing of fuel supplied to the ICE 12, a fuel vapor flow rate through the PCV valve 40, and/or states of intake and exhaust valves of the ICE 12.

The total mass flow rate module 104 is configured to determine a total mass (or gas) flow rate $\dot{m}_{tot}$ per cylinder, per bank of cylinders, and/or for all cylinders of the ICE 12. This may be determined based on the signals from the sensors 21, 25, 43, 44, position of the throttle 16, amounts and timing of fuel supplied to the ICE 12, a fuel vapor flow rate through the PCV valve 40, and/or states of intake and exhaust valves of the ICE 12. The total mass (or gas) flow rate $\dot{m}_{tot}$ corresponds to metered air and fuel vapor associated with PCV flow. Although shown separate from the DFCO inhibit module 62, one or more of the modules 102, 104, 106 may be included in the DFCO inhibit module 62.

The air fuel ratio module 106 determines a stoichiometric air-to-fuel ratio $AFR_{stoich}$ for a fuel vapor. As an example, the stoichiometric air-to-fuel ratio $AFR_{stoich}$ for gasoline fuel vapor is 14.7:1 and adding ethanol decreases the stoichiometric air-to-fuel ratio $AFR_{stoich}$. Pure ethanol has a stoichiometric air-to-fuel ratio $AFR_{stoich}$ of 9:1. The control module 60 and/or combustion module 100 may receive a signal indicating the ethanol concentration of the fuel supplied to the ICE 12 from a sensor or estimate it based on oxygen sensor feedback. As a default, the control module 60 and/or combustion module 100 may use a predetermined constant concentration value based on available market fuel concentrations. Concentration values received and/or predetermined may then be used to determine the stoichiometric air-to-fuel ratio $AFR_{stoich}$. The air fuel ratio module 106, the DFCO inhibit module 62 and/or a reaction gas flow rate module 112 of the DFCO inhibit module 62 may determine an air-fuel equivalence ratio $\lambda$ (lamda), which is equal to a current air-to-fuel ratio AFR divided by the stoichiometric air-to-fuel ratio $AFR_{stoich}$.

The DFCO inhibit module 62 inhibits DFCO during certain conditions by generating an inhibit signal INH, which is provided to the DFCO enable module 108. The DFCO enable module 108 enables (or activates) DFCO during certain conditions and based on the inhibit signal INH. The DFCO enable module 108, for example, temporarily deactivates DFCO while the inhibit signal INH is HIGH and reactivates DFCO in response to the inhibit signal INH transitioning LOW.

The DFCO inhibit module 62 may include the reaction gas flow rate module 112, a temperature offset module 114, a steady-state temperature module 116, a summer 118, a catalyst temperature module 120, and a comparison module 122. The DFCO inhibit module 62, the summer 118, the modules 112, 114, 116, 120, 122, and the DFCO enable module 108 are further described with respect to FIG. 4 below.

Figure 4:
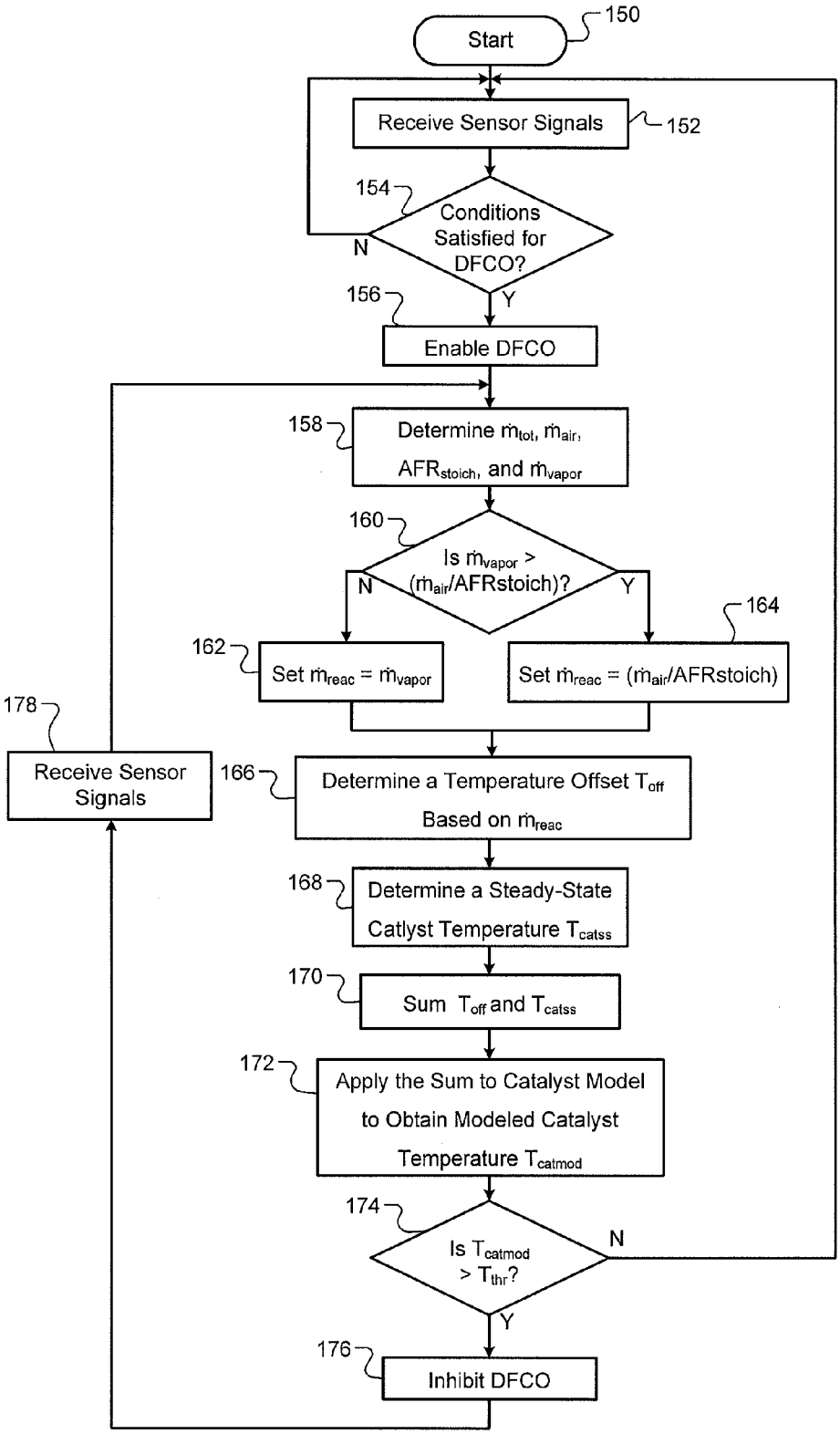
FIG. 4 illustrates a DFCO inhibit method in accordance with the present disclosure.

The systems disclosed herein may be operated using numerous methods, an example method is illustrated in FIG. 4. In FIG. 4, a DFCO inhibit method (may be referred to as an algorithm) is shown. The DFCO inhibit method models effects of fuel vapor, which passes through a cylinder unburned, based on temperatures of one or more catalyst in an exhaust system. Although the following tasks are primarily described with respect to the implementations of FIGS. 1-3, the tasks may be easily modified to apply to other implementations of the present disclosure. The tasks may be iteratively performed. The following tasks may be performed for each bank of cylinders of an engine and corresponding catalysts. For example, an 8 cylinder engine may include two banks of 4 cylinders. Each of the banks may have a corresponding catalyst in an exhaust system.

The DFCO inhibit method may begin at 150. At 152, sensors signals, such as the sensor signals provided by the sensors 21, 24, 25, 43, 44, 55 are received at the combustion module 100. Other sensor signals, condition signals, and/or parameter signals may also be received and/or determined. For example, throttle position, states of intake valves, states of exhaust valves, spark timing, fuel timing, and/or other engine and/or exhaust parameters may be determined. Acceleration (or deceleration) of the engine may also be determined.

At 154, the DFCO enable module 108 determines whether first conditions exist to enable DFCO. For example, DFCO may be enabled when: speed of the ICE 12 is less than a predetermined speed; torque output of the ICE 12 is less than a predetermined torque; acceleration of the engine is less than a predetermined acceleration; and/or load on the ICE 12 is less than a predetermined load. At 156, if the first conditions are satisfied, DFCO is enabled such that the amount of fuel is reduced and/or the fuel is deactivated to one or more cylinders of the ICE 12. The amount of fuel may be reduced and/or the fuel may be deactivated to the one or more cylinders while the amount of fuel remains unchanged and/or activated for one or more other cylinders of the ICE 12. Task 156, may be performed while a vehicle is ON (i.e. has not been shut down since a last activation via, for example, an ignition key and/or a "push start" switch).

At 158, the total gas flow rate $\dot{m}_{tot}$, the total air flow rate $\dot{m}_{air}$, the stoichiometric air-to-fuel ratio $AFR_{stoich}$ (and/or the air-fuel equivalence ratio $\lambda$), and the total fuel vapor flow rate $\dot{m}_{vapor}$ are determined and/or estimated via the modules 102, 104, 106, 110 and/or 112. These values may be determined per bank of cylinders of the ICE 12. The total gas flow rate $\dot{m}_{tot}$, the total fuel vapor flow rate $\dot{m}_{vapor}$ and the stoichiometric air-to-fuel ratio $AFR_{stoich}$ may be determined as described above. The air-fuel equivalence ratio $\lambda$ is equal to a current air-to-fuel ratio AFR divided by the stoichiometric air-to-fuel ratio $AFR_{stoich}$. The current air-to-fuel ratio AFR is equal to the total air flow rate $\dot{m}_{air}$ divided by a total fuel flow rate $\dot{m}_{fuel}$ (or total fuel vapor flow rate $\dot{m}_{vapor}$ since fuel is disabled). The fuel-in-oil dilution module 102 determines the total fuel vapor flow rate $\dot{m}_{vapor}$ through a cylinder, a bank of cylinders, and/or to a catalyst of the ETS 52 based on, for example, the signals from the sensors 21, 25, 43, 44, the manifold air pressure (MAP), an engine temperature (e.g., engine oil temperature $T_{oil}$), position of the throttle 16, a fuel vapor flow rate through the PCV valve 40, and/or states of intake and exhaust valves of the ICE 12. The MAP may be used to estimate a PCV flow rate. The engine temperature may be used to estimate an evaporation rate. The total fuel vapor flow rate $\dot{m}_{vapor}$ may be determined based on and/or as a function of the PCV flow rate and the evaporation rate.

The reaction gas flow rate module 112 may determine the total air flow rate $\dot{m}_{air}$. The total air flow rate $\dot{m}_{air}$ may be determined based on the total gas flow rate $\dot{m}_{tot}$ and total fuel vapor flow rate $\dot{m}_{vapor}$.

At 160, the reaction gas flow rate module 112 determines whether the total fuel vapor flow rate $\dot{m}_{vapor}$ is greater than the total air flow rate $\dot{m}_{air}$ divided by the stoichiometric air-to-fuel ratio $AFR_{stoich}$ $$\left(\text{i.e. whether } \dot{m}_{vapor} > \frac{\dot{m}_{air}}{AFR_{stoich}}\right).$$

As an alternative and if the air-fuel equivalence ratio $\lambda$ is used, the reaction gas flow rate module 112 may determine whether the air-fuel equivalence ratio $\lambda$ is less than 1 (if $\lambda<1$ then the AFR is rich). These comparisons indicate whether the AFR is rich and are used to limit the calculation of fuel vapor not to exceed stoichiometry with the reactant (air) provided. Thus, the total fuel flow rate $\dot{m}_{fuel}$ (or total fuel vapor flow rate $\dot{m}_{vapor}$) may be linearly increased until the air-fuel equivalence ratio $\lambda$ is equal to 1 and then may be maintained at a constant value while the air-fuel equivalence ratio $\lambda$ is less than or equal to 1. The constant value may be a modeled and/or predetermined value.

At 162, if the result of task 160 is FALSE, the reaction gas flow rate module 112 sets a reaction gas flow rate $\dot{m}_{threat}$ equal to the total fuel vapor flow rate $\dot{m}_{vapor}$ (i.e. $\dot{m}_{reac}=\dot{m}_{vapor}$).

At 164, if the result of task 160 is TRUE, the reaction gas flow rate module 112 sets the reaction gas flow rate $\dot{m}_{reac}$ equal to the total air flow rate $\dot{m}_{air}$ divided by the stoichiometric air-to-fuel ratio $AFR_{stoich}$ $$\left(\text{i.e. } \dot{m}_{reac} = \frac{\dot{m}_{air}}{AFR_{stoich}}\right).$$

This limits the reaction gas flow rate $\dot{m}_{reac}$ to stoichiometry and/or a maximum predetermined reaction gas flow rate. As the amount of fuel vapor passed to the catalyst increases, the amount of heat generated $\dot{Q}_{gen}$ increases. The amount of heat increases to a limit. This limit is based on a stoichiometric ratio for that fuel vapor. The amount of heat generated $\dot{Q}_{gen}$ is a function of the reaction gas flow rate $\dot{m}_{reac}$. This relationship is represented through use of the table to provide the temperature offset $T_{off}$.

At 166, the temperature offset module 114 determines a temperature offset $T_{off}$. The temperature offset $T_{off}$ is determined based on the reaction gas flow rate $\dot{m}_{reac}$. The temperature offset module 114 may store and/or access a table 167. The table 167 may relate temperature offset values to reaction gas flow rate values. As the reaction gas flow rate values increase, the temperature offset values increase.

At 168, the steady-state temperature module 116 estimates a steady-state temperature $T_{catss}$ of the catalyst (e.g., the catalyst 53). The steady-state temperature module 116 may estimate the steady-state temperature $T_{catss}$ of the catalyst based on the received sensor signals, engine speed, engine output torque, engine load, the air-fuel equivalence ratio $\lambda$, spark timing, fuel timing, and/or other engine and exhaust system parameters. The steady-state temperature $T_{catss}$ may be a target temperature determined based on the received sensor signals, engine speed, engine output torque, engine load, the air-fuel equivalence ratio $\lambda$, spark timing, fuel timing, and/or other engine and exhaust system parameters. The steady-state temperature $T_{catss}$ of the catalyst may be determined based on one or more predetermined models of the ICE 12, the ETS 52 and the catalyst. The models may include predetermined equations and/or tables for determining the steady-state temperature $T_{catss}$. The tables may include predetermined temperatures corresponding to the above-stated parameters.

At 170, the summer 118 sums the temperature offset $T_{off}$ and the steady-state temperature $T_{catss}$ to provide a summation value SUM. This offsets the steady-state temperature $T_{catss}$ as a function of the reaction gas flow rate $\dot{m}_{reac}$.

At 172, the catalyst temperature module 120 performs as a filter and converts the summation value to a modeled temperature $T_{catmod}$ of the catalyst. The modeled temperature $T_{catmod}$ is estimated based on a predetermined model of the catalyst. The predetermined model of the catalyst may include predetermined equations and/or tables for determining the modeled temperature $T_{catmod}$. The model of the catalyst may be based on an inlet gas temperature and/or pressure of the catalyst, an outlet gas temperature and/or pressure of the catalyst, and an ambient temperature. The modeled temperature $T_{catmod}$ is an updated actual temperature of the catalyst and changes at a slower rate than the steady-state temperature $T_{catss}$. This is because the actual temperature of the catalyst changes at a slower rate than the adjustment to parameters of the ICE 12. To clarify, temperature of an object with mass cannot change instantaneously. Since the catalyst has mass, it approaches a "steady-state target temperature", but since real steady-state conditions rarely exist in engine operation, the modeled temperature $T_{catmod}$ rarely reaches the steady-state temperature.

At 174, the comparison module 122 compares the modeled temperature $T_{catmod}$ to a predetermined threshold $T_{thr}$. If the modeled temperature $T_{catmod}$ is greater than the predetermined threshold $T_{thr}$, then the comparison module 122 sets the inhibit signal INH to HIGH (or first state) and DFCO is inhibited at 176. If the modeled temperature $T_{catmod}$ is less than or equal to the predetermined threshold $T_{thr}$, then the comparison module 122 sets the inhibit signal INH to LOW (or second state) and task 152 is then performed. As a result, the modeled temperature $T_{catmod}$ may increase at a calibratable rate until a maximum safe operating temperature (e.g., temperature less than or equal to the predetermined threshold $T_{thr}$ or a temperature within a predetermined range of the predetermined threshold $T_{thr}$) for the catalyst is reached. At this time, cylinders can be re-enabled to protect the catalyst. The reenabling of the cylinders enables burning of fuel vapor in the cylinders and reduces the amount of unburned fuel vapor that passes to the catalyst, which decreases the temperature of the catalyst. If DFCO is requested when the modeled temperature $T_{catmod}$ decreases to a temperature less than or equal to the maximum safe operating temperature, DFCO may again be reactivated to reduce and/or deactivate fuel to the one or more cylinders at 156.

Subsequent to task 176, task 178 may be performed. At 178, sensor signals may be received and parameters may be determined as at 152. Task 158 may be performed subsequent to task 178.

The above-described tasks are meant to be illustrative examples; the tasks may be performed sequentially, synchronously, simultaneously, continuously, during overlapping time periods or in a different order depending upon the application. Also, any of the tasks may not be performed or skipped depending on the implementation and/or sequence of events.

The above described implementations account for and model effects of unburned A/F mixtures via a temperature model of a catalyst. The implementations also account for stoichiometry associated with a fuel vapor and limit reaction gas flow rates. As a result, the reaction gas flow rate determinations comply with physics associated with the catalyst. As stoichiometry is approached (at a given airflow, ie, fuel flow increasing), heat generation in the catalyst reaches a plateau or no longer increases. DFCO is disabled when the modeled (filtered) catalyst temperature reaches the predetermined threshold potentially associated with catalyst damage.

The implementations maximize an amount of time that DFCO is enabled by temporarily inhibiting DFCO based on an actual temperature of a catalyst instead of completely preventing DFCO from being activated. DFCO, in and of itself, does not typically raise the temperature of a catalyst. Disabling DFCO is provided when fuel vapors are present. The advantage of this method is that DFCO is permitted when fuel vapor is present for a short period. In this way, DFCO is disabled during long deceleration conditions. This is because the catalyst cannot handle the prolonged reaction and associated increase in temperature during these conditions.

Inhibiting DFCO allows for ignition of fuel vapor in a cylinder (or combustion chamber), which reduces the amount of heat generated within an exhaust system. The associated energy is applied to producing torque in the engine instead of producing heat in the catalyst. This can reduce the temperature of the catalyst to a temperature existing prior to activation of DFCO. At this point, DFCO may be reactivated.

Using the provided algorithm, the temperature model of the catalyst is used to estimate effects of fuel vapor provided by a PCV system during a DFCO mode and/or any mode in which fuel is disabled. Temporarily disabling DFCO provides short duration DFCO events when fuel vapor is present in an exhaust system. DFCO is not disabled unless the temperature threshold $T_{thr}$ is exceeded, which allows for a maximum amount of use of DFCO for improved fuel economy.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A system comprising:

a deceleration fuel cut-off (DFCO) module configured to operate in a DFCO mode to deactivate fuel to a cylinder of an engine;

a first flow rate module configured to determine a reaction gas flow rate;

an offset module configured to determine a temperature offset value based on the reaction gas flow rate;

a first temperature module configured to estimate a first temperature of a catalyst of an exhaust system of the engine;

a summer configured to sum the temperature offset value and the first temperature to generate a summation value;

a second temperature module configured to estimate a second temperature of the catalyst based on the summation value; and a comparison module configured to (i) perform a first comparison between the second temperature and a threshold, and (ii) generate an inhibit signal to inhibit operation in the DFCO mode based on the first comparison, wherein the DFCO module is configured to temporarily deactivate the DFCO mode based on the inhibit signal.

2. The system of claim 1, further comprising:

a second flow rate module configured to determine a fuel vapor flow rate; and an air fuel ratio module configured to determine a stoichiometric air-to-fuel ratio, wherein the first flow rate module is configured to (i) determine an air flow rate, and (ii) determine the reaction gas flow rate based on the air flow rate, the fuel vapor flow rate, and the stoichiometric air-to-fuel ratio.

3. The system of claim 1, wherein the first flow rate module is configured to determine whether to set the reaction gas flow rate equal to (i) a fuel vapor flow rate, or (ii) an air flow rate divided by a stoichiometric air-to-fuel flow ratio.

4. The system of claim 3, wherein the first flow rate module is configured to:

perform a second comparison between (i) the fuel vapor flow rate and (ii) the air flow rate divided by the stoichiometric air-to-fuel flow ratio; and based on the second comparison, set the reaction gas flow rate equal to (i) the fuel vapor flow rate, or (ii) the air flow rate divided by the stoichiometric air-to-fuel flow ratio.

5. The system of claim 1, wherein the comparison module is configured to (i) determine whether the second temperature is greater than the threshold, and (ii) if the second temperature is greater than the threshold, generate the inhibit signal to inhibit operation in the DFCO mode.

6. The system of claim 1, wherein:

the comparison module is configured to (i) determine whether the second temperature is greater than the threshold, and (ii) if the second temperature is less than or equal to the threshold, change a state of the inhibit signal to permit operation in the DFCO mode; and the DFCO module is configured to reactivate the DECO mode based on the inhibit signal.

7. The system of claim 1, further comprising a second flow rate module configured to determine a total gas flow rate, wherein the first flow rate module is configured to (i) determine an air flow rate, and (ii) determine the reaction gas flow rate based on the total gas flow rate and the air flow rate.

8. The system of claim 7, wherein the total gas flow rate is equal to a sum of the air flow rate and a fuel vapor flow rate.

9. The system of claim 1, wherein:

the first temperature module is configured to estimate the first temperature based on first parameters of the engine;

the first temperature is a steady-state temperature of the catalyst;

the first parameters include a speed of the engine, a torque or load of the engine, and an air-to-fuel equalization ratio;

the second temperature module is configured to estimate the second temperature based on the summation value and second parameters; and the first parameters include an inlet gas temperature of the catalyst and an outlet gas temperature of the catalyst.

10. A method comprising:

operating an engine in a deceleration fuel cut-off (DFCO) mode to deactivate fuel to a cylinder of the engine;

determining a reaction gas flow rate;

determining a temperature offset value based on the reaction gas flow rate;

estimating a first temperature of a catalyst of an exhaust system of the engine;

summing the temperature offset value and the first temperature to generate a summation value;

estimating a second temperature of the catalyst based on the summation value;

performing a first comparison between the second temperature and a threshold;

generating an inhibit signal to inhibit operation in the DFCO mode based on the first comparison; and temporarily deactivating the DFCO mode based on the inhibit signal.

11. The method of claim 10, further comprising:

determining an air flow rate;

determining a fuel vapor flow rate; and determining a stoichiometric air-to-fuel ratio, wherein the determining of the reaction gas flow rate is based on the air flow rate, the fuel vapor flow rate, and the stoichiometric air-to-fuel ratio.

12. The method of claim 10, further comprising determining whether to set the reaction gas flow rate equal to (i) a fuel vapor flow rate, or (ii) an air flow rate divided by a stoichiometric air-to-fuel flow ratio.

13. The method of claim 12, further comprising:

performing a second comparison between (i) the fuel vapor flow rate and (ii) the air flow rate divided by the stoichiometric air-to-fuel flow ratio; and based on the second comparison, setting the reaction gas flow rate equal to (i) the fuel vapor flow rate, or (ii) the air flow rate divided by the stoichiometric air-to-fuel flow ratio.

14. The method of claim 10, further comprising:

determining whether the second temperature is greater than the threshold; and if the second temperature is greater than the threshold, generating the inhibit signal to inhibit operation in the DFCO mode.

15. The method of claim 10, further comprising:

determining whether the second temperature is greater than the threshold;

if the second temperature is less than or equal to the threshold, changing a state of the inhibit signal to permit operation in the DECO mode; and reactivating the DECO mode based on the inhibit signal.

16. The method of claim 10, further comprising:

determining a total gas flow rate; and determining an air flow rate, wherein the determining of the reaction gas flow rate is based on the total gas flow rate and the air flow rate.

17. The method of claim 16, wherein the total gas flow rate is equal to a sum of the air flow rate and a fuel vapor flow rate.

18. The method of claim 10, wherein:

the estimating of the first temperature is based on first parameters of the engine;

the first temperature is a steady-state temperature of the catalyst;

the first parameters include a speed of the engine, a torque or load of the engine, and an air-to-fuel equivalence ratio;

the estimating of the second temperature is based on the summation value and second parameters; and the first parameters include an inlet gas temperature of the catalyst and an outlet gas temperature of the catalyst.

* * * * *